US005858917A

United States Patent [19]

Yamazaki et al.

[11] Patent Number: 5,858,917

[45] Date of Patent: Jan. 12, 1999

[54] IMAGE-RECEIVING SHEET FOR THERMAL TRANSFER PRINTING AND METHOD FOR MANUFACTURING SAME

[75] Inventors: Masayasu Yamazaki; Satoru Kawai; Kenichiro Suto; Hitoshi Saito, all of Tokyo-to, Japan

[73] Assignee: Dai Nippon Printing Co., Ltd., Tokyo-to, Japan

[21] Appl. No.: 799,474

[22] Filed: Feb. 12, 1997

[30] Foreign Application Priority Data

Feb. 16, 1996 [JP] Japan ..... 8-052556

[51] Int. Cl.[6] ..... B41M 5/24

[52] U.S. Cl. ..... 503/227; 428/195; 428/913; 428/914

[58] Field of Search ..... 503/227; 428/195, 428/913, 914

[56] References Cited

U.S. PATENT DOCUMENTS

| | | | |
|---|---|---|---|
| 5,106,816 | 4/1992 | Morohoshi et al. | 503/227 |
| 5,587,352 | 12/1996 | Tamura et al. | 503/227 |
| 5,665,676 | 9/1997 | Nakamura et al. | 428/914 |

FOREIGN PATENT DOCUMENTS

| | | | |
|---|---|---|---|
| 0621138 | 10/1994 | European Pat. Off. | B41M 5/00 |

OTHER PUBLICATIONS

Derwent Database WPI, Section Ch, Week 8804, Abstract of JP–62–284,784, Dainippon Ink & Chem KK, Dec. 10, 1987.

Abstract of JP–3–024,995, European Patent Office Patent Abstracts of Japan, vol. 015, No. 146, Tomoegawa Paper Co. Ltd. Feb. 1, 1991.

Encyclopedia of Polymer Science and Engineering vol. 15, 2nd ed. p. 204, 1989.

*Primary Examiner*—Melvyn I. Marquis
*Attorney, Agent, or Firm*—Ladas & Parry

[57] ABSTRACT

An image-receiving sheet for thermal transfer printing, comprises a substrate and a receptor layer provided on at least one surface of the substrate. The receptor layer is formed by applying a receptor layer forming composition comprising (a) at least one kind of thermoplastic resin and (b) at least one kind of release agent selected from silicone compounds expressed by the following formula (1):

$$R_1—Si—(NCO)_{4-1} \quad (1)$$

[in the formula (1), "1" indicates an integer of from 0 to 3, and "R" indicates an alkyl group, an aryl group or a vinyl group], to the at least one surface of the substrate, and drying the thus applied composition by heat.

12 Claims, 1 Drawing Sheet

IMAGE-RECEIVING SHEET FOR THERMAL TRANSFER PRINTING AND METHOD FOR MANUFACTURING SAME

FIELD OF THE INVENTION

The present invention relates to an image-receiving sheet for thermal transfer printing, and more specifically to an image-receiving sheet for thermal transfer printing, having releasability which is so excellent as to cause no heat-fusion of the image-receiving sheet for thermal transfer printing and a thermal transfer sheet upon forming an image, permitting the formation of the image with a high dyeing affinity, and having a receptor layer which is not subject to flaws on the surface thereof even when there is caused friction between the stacked image-receiving sheets for thermal transfer printing by for example supplying them, and even when there is caused friction between the surface of the receptor layer and parts of a printer. The present invention may suitably be applied to a sublimation type thermal transfer printing.

BACKGROUND OF THE INVENTION

Many kinds of thermal transfer printing methods have conventionally been known. Of these methods, public attention has been attracted by a sublimation type thermal transfer printing method in which an image can be formed on a image-receiving sheet for thermal transfer printing by heating, with the use of a heating means such as a thermal head or a laser, a thermal transfer sheet which had been prepared by forming a thermal transfer layer containing sublimative dyes on a support such as a polyester film, and has been placed on the image-receiving sheet for thermal transfer printing. Such a sublimation type thermal transfer printing method has been utilized as an information recording means in many kinds of fields of art.

According to such a sublimation type thermal transfer printing method, it is possible to form an image in various colors in an extremely short period of time, which bears comparison with a color photographic image having excellent reproducibility in neutral tints and toning property.

This method may provide an advantage that there can be obtained an image which is very clear and excellent in transparency, since according to this method, resin in the receptor layer is dyed by means of a dye to form the image. Therefore, this method has extensively been applied to the formation of a transparent projection sheet to be used for a projecting apparatus such as an overhead projector (hereinafter abbreviated to "OHP").

With respect to such use, a conventional image-receiving sheet for thermal transfer printing for the OHP has a receptor layer formed on one surface of a transparent substrate having a thickness of about 100 $\mu$m and made of polyethylene terephthalate (hereinafter abbreviated to "PET"), and a back surface layer formed on the other surface thereof.

On the one surface of the substrate, there is provided with a receptor layer made of thermoplastic resin such as, for example, saturated polyester resin, vinyl chloride-vinyl acetate copolymer and polycarbonate resin in order to receive sublimative dyes transferred from the thermal transfer sheet and keep the formed image, and, if necessary, also provided with an intermediate layer.

There is provided, as an intermediate layer, a layer for imparting a cushioning property to an image-receiving sheet for thermal transfer printing, when a substrate made of PET having a high rigidity is for example used, or a layer for imparting an antistatic property thereto.

On the other surface, i.e., the back surface of the substrate, there is provided, if necessary, with a back surface layer formed by applying a composition prepared by adding an organic filler made of acrylic resin, fluoroplastics, polyamide resin or the like and/or an inorganic filler such as silica to a binder of acrylic resin or the like, in order to prevent the image-receiving sheet for thermal transfer printing from being curled up and improve an slipping property.

A so-called "standard type" image-receiving sheet for thermal transfer printing is used for projecting an image of the image-receiving sheet not by means of transmitted light but by means of reflected light. The standard type image-receiving sheet has substantially the same structure as that of the transmission type image-receiving sheet described above except that there may be used as an substrate an opaque, for example, white plastic sheet made of PET, foamed PET or the like; ordinary paper; synthetic paper; the combination of them adhered to each other or the like.

There has also been utilized for various uses a so-called "sticker-type" image-receiving sheet for thermal transfer printing in which a receptor layer was formed on the one surface of a substrate, and adhesive layer made of adhesive agent and a release paper were provided in this order on the other surface of the substrate. The sticker-type image-receiving sheet is used by forming an image on the receptor layer by means of a thermal transfer printing, peeling the release paper and sticking the image-receiving sheet on a desired object.

In the conventional image-receiving sheets for thermal transfer printing, various release agents are added to the receptor layers thereof, or a release layer is formed on the receptor layer. As a release agent, there has often been used silicone or a compound thereof such as silicone resin, and curable modified silicone has especially been used to improve releasability from the thermal transfer sheet.

The use of a certain kind of silicone has however caused a problem that the receptor layer was easily subject to flaws through friction between the receptor layer side surface of an image-receiving sheet and the back surface of the other image-receiving sheet and/or through friction between the surface of the receptor layer and parts of a printer, during the feeding of the image-receiving sheets in the printer, resulting in occurrence of so called abnormal transfer printing of causing the heat-fusion of the heat transfer sheet and the image-receiving sheet at portions having the above-mentioned flaws of the latter, the transfer of the entire layer of the dyeing layer, and the peeling of the receptor layer from the substrate. This means the poor abrasion resistance of the conventional image-receiving sheets for thermal transfer printing.

There has also been known a curing type release agent in which amino-modified silicone and epoxy-modified silicone are utilized. Such a release agent has however a problem that a long period of time is required for the curing thereof.

There has been carried out a practical step of adding a large amount of such a silicone compound to a receptor layer or increasing a thickness of a release layer, in order to achieve a sufficient releasing property with the use of the silicone compound. Such a practical step may cause occurrence of problems of degradation in dyeing affinity and decrease in depth of a formed image.

There has also been carried out a practical step of causing silicone oil having active hydrogen, such as hydroxyl group-modified silicone oil, carboxyl-modified silicone oil or amino-modified silicone oil to react on a curing agent such as isocyanate compounds or organic metallic compounds to cure such a kind of silicone oil, so as to achieve an abrasion resistance as well as a releasing property. Such a practical step may cause occurrence of a problem that the above-mentioned reaction requires a baking process which must be carried out at a high temperature for a long period of time, and an aging process which must be carried out for a long period of time after a drying process, thus requiring a long period of time for the reaction, resulting in poor productivity. A baking process which is carried out at a low temperature for a short period of time, may provide insufficient releasing property even when an aging process is carried out after the baking process. When an amount of added curing agent and/or catalyst is increased to an extent that a releasing property can be obtained, there are caused problems that the service life of a coating composition becomes very short, the coating composition easily tends to gel before a coating process, and an application property of the coating composition is deteriorated.

SUMMARY OF THE INVENTION

An object of the present invention is to provide an image-receiving sheet for thermal transfer printing, which permits to solve the above-mentioned problems, prevents the image-receiving sheet for thermal transfer printing from being heat-fused onto a heat transfer sheet upon forming an image, has excellent abrasion resistance and releasing property, and permits the formation of an image with a high dyeing affinity, and a method for manufacturing the above-mentioned image-receiving sheet for thermal transfer printing.

The image-receiving sheet for thermal transfer printing provided in accordance with the present invention, which comprises a substrate and a receptor layer provided on at least one surf ace of the substrate, is characterized in that:

the receptor layer is formed by applying a receptor layer forming composition comprising (a) at least one kind of thermoplastic resin and (b) at least one kind of release agent selected from silicon compounds expressed by the following formula (1):

$$R_1—Si—(NCO)_{4-1} \quad (1)$$

[in the formula (1), "1" indicates an integer of from 0 to 3, and "R" indicates an alkyl group, an aryl group or a vinyl group], to the at least one surface of the substrate, and drying the thus applied composition by heat.

The silicone compound expressed by the above-mentioned formula (1) has an isocyanate group and is a curing type release agent. When the silicone compound expressed by the formula (1) is contained as a release agent in the receptor layer forming composition, there does not easily occur heat-fusion between the receptor layer made from this composition and the thermal transfer sheet upon forming an image, and excellent abrasion resistance and releasability can be obtained. Moreover, an excellent dyeing affinity can also be obtained, thus permitting an image having good quality.

It is preferable to add modified silicone having an active hydrogen, such as a compound expressed by the following formula (2), to the receptor layer forming composition:

$$R^2—Si(R^3)_2—O\left[\begin{matrix}R^2\\|\\Si(R^3)—O\end{matrix}\right]_a\left[Si(R^3)_2—O\right]_b—Si(R^3)_2—R^2 \quad (2)$$

[in the formula (2), each siloxane unit may be arranged at random; each of "a" and "b" indicates an integer equal or more than 0 (zero), and a sum of "a" and "b" amounts to at least 1; each "$R^2$" independently indicates a methyl group or a group selected from the group consisting of $—(CH_2)_m—OH$, $—(CH_2)_n—COOH$ and $—C_3H_6NH_2$; each of "m" and "n" indicates an integer of from 0 to 5; and "$R^3$" indicates a methyl group, however, part of "$R^3$" may be substituted by at least one kind of group selected from the group consisting of an ethyl group, a phenyl group and a 3,3,3-trifluoropropyl group].

When the modified silicone having the active hydrogen is contained in the receptor layer forming composition, the silicone compound expressed by the formula (1), having the isocyanate group is caused to react also on the modified silicone expressed by the formula (2) to perform the curing. Therefore, there occurs almost no heat-fusion between the resultant receptor layer and the thermal transfer sheet, and besides, an abrasion resistance, releasability and a dyeing affinity can further be improved.

The thermosetting resin contained in the receptor layer forming composition preferably has an active group such as active hydrogen. The silicone compound expressed by the formula (1), having the isocyanate group can be caused to react also on the thermoplastic resin having the active group to perform the curing. In this case, there also occurs almost no heat-fusion between the resultant receptor layer and the thermal transfer sheet, and besides, an abrasion resistance, releasability and a dyeing affinity can further be improved.

The silicone compound expressed by the formula (1), used as the release agent in the present invention has a high reaction velocity, and can react at a relative low temperature, thus requiring no aging process upon forming the receptor layer, and leading to a high productivity. The image-receiving sheet for thermal transfer printing of the present invention can provide advantageous effects also in the manufacturing steps.

DETAILED DESCRIPTION OF THE PREFERRED EMBODIMENTS

Figure 1:
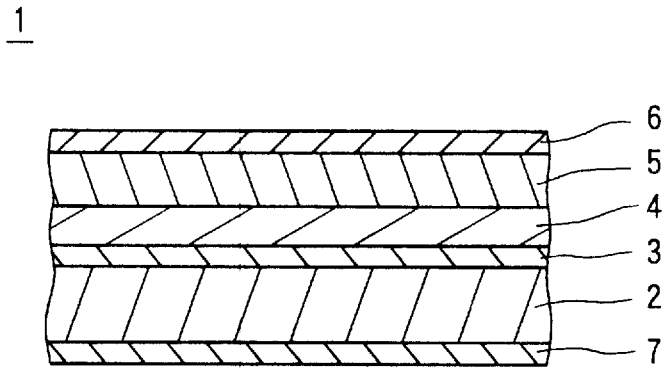
FIG. 1 is a schematic sectional view illustrating an image-receiving sheet for thermal transfer printing of an embodiment of the present invention.

An embodiment of the present invention will be described hereinafter. An image-receiving sheet 1 for thermal transfer printing of the present invention exemplified in FIG. 1 has a structure in which there are formed, on the surface of a substrate 2, an adhesion promotive layer 3, an intermediate layer 4, a receptor layer 5 and an antistatic layer 6 in this order, and there is formed, on the other surface thereof, a back surface layer 7. In the present invention, only the substrate 2 and the receptor layer 5 are essential, and the remaining layers may be added or omitted, if necessary. Another different layer may exist between the substrate 2 and the receptor layer 5.

[Substrate]

The substrate preferably has a function of holding the receptor layer, and physical properties of bearing with heat applied during the formation of an image and being handled without causing any problems in strength. As a materials for forming the substrate, there may be used a film or sheet of plastic material such as polyester, polyacrylate, polycarbonate, polyurethane, polyimide, polyetherimide, cellulose derivative, polyethylene, ethylene-vinyl acetate copolymers, polypropylene, polystyrene, acryl, polyvinyl chloride, polyvinylidene chloride, polyvinyl alcohol, polyvinyl butyral, nylon, polyether etherketone, polysulfone, polyethersulfone, tetrafluoroethylene-(perfluoroalkyl) vinylether copolymers, polyvinyl fluoride, tetrafluoroethylene-ethylene copolymers, tetrafluoroethylene-hexafluoropropylene copolymers, polychlorotrifluoroethylene and polyvinylidene fluoride, to which the material for forming the substrate is not especially limited. Of these materials, a transparent film or sheet may be selected and utilized for the use of a projection sheet for the OHP.

For the standard type image-receiving sheet, there may be used the same film or sheet of the synthetic resin as exemplified above, a white film formed by adding a white pigment or a filler to that synthetic resin, a foamed sheet of that synthetic resin, and other paper such as condenser paper, glassine, parchment paper, (polyolefin- or polystyrene-) synthetic paper, fine paper, art paper, coated paper, cast-coated paper, synthetic resin- or emulsion-impregnated paper, synthetic rubber-latex-impregnated paper, paper backed with synthetic resin or cellulose fiber paper.

There may also be used a laminated body of the combination of the sheets or films of optionally selected materials of the above-mentioned materials for the substrate. Typical examples thereof may include a laminated body of the cellulose fiber paper and the synthetic paper and another laminated body of the cellulose fiber paper and the plastic film.

There may further be used a substrate provided with an adhesion promotive layer on one surface and/or the other surface of the above-mentioned substrate.

In the present invention, it is preferable to select a substrate of the above-described substrates, which has a surface electrical resistivity of up to $1.0\times10^{12}\Omega/\square$ (ohm/square) at a temperature of 20° C. and a relative humidity of 50%, or to apply an antistatic treatment to any one of the above-described substrates so as to keep a surface electrical resistivity up to $\mathbf{1.0\times10^{12}}\Omega/\square$ (ohm/square) under the same conditions as mentioned above. The use of such a substrate permits not only the prevention of occurrence of unfavorable electrostatic problems during the production of the image-receiving sheets for thermal transfer printing, but also the improvement in effect of an antistatic agent to be applied onto the image-receiving surface and the back surface of the image-receiving sheet for thermal transfer printing, although the latter will be discussed below in the description of a preferred embodiment of the present invention.

Although these substrates have in general a thickness of from about 3 to 300 $\mu$m, it is preferable to use the substrate having a thickness of from 75 to 175 $\mu$m in the present invention, taking into consideration mechanical properties thereof and the like. If there is a poor adhesion between the substrate and a layer to be formed thereon, it is preferable to apply an easy adhesive treatment or a corona discharge treatment to the contacting surfaces of them.

[Receptor Layer]

The receptor layer of the present invention, which is formed on at least one surface of the substrate and contains at least one kind of thermoplastic resin, receives sublimative dyes transferred from the thermal transfer sheet and keeps the formed image.

Examples of material for forming the receptor layer may include halogenated polymer such as polyvinyl chloride and polyvinylidene chloride; vinyl resin such as polyvinyl acetate, ethylene-vinyl acetate copolymers, vinyl chloride-vinyl acetate copolymer, polyacrylic ester, polystyrene and polystyrene acryl; acetal resin such as polyvinyl formal, polyvinyl butyral and polyvinyl acetal; many kinds of saturated or unsaturated polyester resin; polycarbonate resin; cellulose resin such as cellulose acetate; polyolefin resin; amino resin or polyamide resin such as urea resin, melamine resin and benzoguanamine resin. These resins may be used alone or in a combination in which a plurality of resins are blended in respective compatible amounts.

With respect to the use of a plurality of blended resins, it is necessary to select specific resins having compatibility, when a transparency is required especially for the use of a projection sheet for the OHP.

Of the above-mentioned thermoplastic resins, thermoplastic resins having active groups are preferably used. An active hydrogen may be exemplified as the active group. The active hydrogen preferably exists at the ends of the molecule of the thermoplastic resin, taking into consideration the stability of the thermoplastic resin. When vinyl resin is used, a content of vinyl alcohol is preferably up to 30 wt. %.

When a content of the active hydrogen in the thermoplastic resin is excessively high, there may occur an excessive progress of curing reaction of the resin itself with isocyanate compound expressed by the formula (1) as a release agent, leading to one of factors of degradation of the dyeing depth, and the release agent is cured and fixed in the inside of the receptor layer without causing the exudation of the release agent through the surface of the receptor layer, thus making impossible to impart a sufficient releasing property to the receptor layer.

According to the present invention, at least one kind of silicon compound expressed by the following formula (1) is added as a release agent to the composition for forming the receptor layer:

$$R_1\text{—Si—}(NCO)_{4-1} \qquad (1)$$

In the above-mentioned formula (1), "1" indicates an integer of from 0 to 3, and "R" indicates an alkyl group such as a methyl group, an aryl group such as a phenyl group, or a vinyl group.

The following effects can be obtained by adding monomer expressed by the formula (1) as a release agent to the receptor layer forming composition, carrying out an application process of this composition, and drying the applied composition by heat:

1. Good compatibility to the thermoplastic resin for forming the receptor layer can be obtained because of monomeric release agent;
2. The monomeric release agent permits to easily cause its exudation through the surface of the receptor layer upon carrying out the application process of the composition, and a small amount of added monomeric release agent permits to provide an excellent releasability from the thermal transfer sheet; and
3. The reaction velocity is high and the reaction can be made at a relatively low temperature, thus requiring no aging process, and leading to a high productivity.

When there is used a resin for forming the receptor layer, which has active hydrogen, the following additional effect can be obtained:

4. The monomeric release agent is combined with the resin having the active hydrogen for forming the receptor layer, on the surface of the receptor layer, resulting in the improvement of the abrasion resistance of the image-receiving sheet for thermal transfer printing, and the prevention of occurrence of a problem that the receptor layer may be chipped upon the carrying of the image-receiving sheet, i.e., upon the supply or discharge thereof in a printer, thus causing an abnormal transfer printing.

In the present invention, the modified silicone having the active hydrogen is preferably included in the receptor layer forming composition. As such a modified silicone, there may be exemplified hydroxyl group-modified silicone, carboxyl-modified silicone and amino-modified silicone which are expressed by the following formula (2):

$$R^2-Si(R^3)_2-O-\left[\begin{array}{c}R^2\\|\\Si(R^3)-O\end{array}\right]_a-\left[Si(R^3)_2-O\right]_b-Si(R^3)_2-R^2 \quad (2)$$

In the above-mentioned formula (2), each siloxane unit may be arranged at random. Each of "a" and "b" indicates an integer equal or more than 0 (zero), and a sum of "a" and "b" amounts to at least 1. "$R^2$" indicates a methyl group or group of —$(CH_2)_m$—OH in case of the hydroxyl group-modified silicone, a methyl group or a group of —$(CH_2)_n$—COOH in the case of the carboxyl-modified silicone, and a methyl group or a group of —$C_3H_6NH_2$ in the case of the amino-modified silicone. The groups of "$R^2$" may be identical to each other or may be different from each other. "m" in the group of —$(CH_2)_m$—OH and "n" in the group of —$(CH_2)_n$—COOH respectively indicate an integer of from 0 to 5, preferably of 1 and 2. "$R^3$" basically indicates a methyl group, however, part of "$R^3$" may be substituted by an ethyl group, a phenyl group and/or a 3,3,3-trifluoro-propyl group. (These description is based on "SILICONE HANDBOOK" published by The Daily Industrial Newspaper Co., Ltd.)

The hydroxyl group-modified silicone is more preferably used in the light of its reactivity.

In the present invention, there are added as a release agent (a) the silicone compound expressed by the formula (1) and (b) the modified silicone having the active hydrogen, expressed by the formula (2) or other modified silicone, if necessary, to the receptor layer forming composition, and the conventional release agent may be used in combination therewith. When one kind or a plural kinds of release agent are used, a total amount of added release agents is preferably within a range of from 0.5 to 10 wt. % to a content of the resin for receptor layer.

Various kinds of additives may be added to the receptor layer forming composition, if necessary. Pigments and fillers such as titanium oxide, zinc oxide, kaolin, clay, calcium carbonate, particulate silica powder or the like may be added thereto for the purpose of improving the whiteness of the receptor layer so as to further improve the clearness of a thermal transferred image. An amount of added pigments or fillers should however be limited to a certain extent that a required transparency can be maintained, when the transparency is required as in the use of a projecting sheet for the OHP.

Known additives such as a plasticizer, an infrared-absorbing agent, a light radiation stabilizer, an antioxidant, a fluorescent whitening agent and an antistatic agent may be added to the receptor layer forming composition, if necessary.

The receptor layer can be formed by (a) adding the above-mentioned release agent and the occationally demanded additives to the above-mentioned resin and fully kneading same with the use of a solvent or a diluent to prepare a receptor layer forming composition, (b) applying the thus prepared receptor layer forming composition onto the above-mentioned substrate by means of a conventional forming method such as a gravure printing method, a screen printing method, a reverse roll coating method with the use of a gravure or the like, and (c) drying the thus applied composition.

The steps for forming an intermediate layer, a back surface layer, an adhesion promotive layer and an antistatic layer which will be described later, are carried out in the same manner as in the above-mentioned steps for forming the receptor layer.

The present invention can also be applied to a sticker-type image-receiving sheet for thermal transfer printing, in which a receptor layer is formed on one surface of a substrate, and an adhesive layer using an adhesive agent and a release paper are laminated in this order on the other surface of the substrate. The steps for forming the adhesive layer are also carried out in the above-mentioned steps for forming the receptor layer.

In order to impart an antistatic property to the receptor layer, the following antistatic agents may be added to the receptor layer forming composition.

the antistatic agent: fatty acid ester, sulfuric ester, phosphoric ester, amide, quaternary ammonium salt, betaine, amino acid, acrylic resin, ethylene oxide adduct and the like.

An amount of added antistatic agent is preferably within a range of from 0.1 to 2.0 wt. % relative to the resin content.

A coating weight of the receptor layer of the image-receiving sheet of the present invention is preferably within a range of from 0.5 g/$m^2$ to 4.0 g/$m^2$ in a dried condition. With a coating weight of the receptor layer of under 0.5 g/$m^2$ in a dried condition, in case where the receptor layer is for example formed directly on the substrate, there may occur insufficient contact of the receptor layer with a thermal head due to factors such as the rigidity of the substrate, resulting in a rough surface of an image in a highlighted portion. This problem can be avoid by forming an intermediate layer for imparting a cushioning effect to the image-receiving sheet between the substrate and the receptor layer. This way however has another problem of being subject to flaws on the receptor layer. The roughened surface of the receptor layer, which is caused by impressing a high energy, tends to be relatively severer according as the coating weight of the receptor layer is increased. When the coating weight thereof is over 4.0 g/$m^2$ in a dried condition, a slightly blackish portion may, for example, appear in a high depth area during the projection with the use of the OHP.

In the following description, any coating amount of a composition according to the present invention is based on a converted value in weight percentage as a solid content in a dried condition, unless a specific reference is made.

[Intermediate Layer]

In the present invention, there may be provided an intermediate layer of many kinds of resin between the substrate and the receptor layer. The formation of the intermediate layer to which prescribed various functions are imparted, permits the addition of excellent functions to the image-receiving sheet for thermal transfer printing.

For example, it is possible to improve the printing sensitivity of the image-receiving sheet for thermal transfer printing and prevent the surface of an image from being roughen by using, as a resin imparting a cushioning effect to the image-receiving sheet for thermal transfer printing, a resin having a large elastic or plastic deformation such as, for example, polyolefin resin, vinyl copolymer resin, polyurethane resin, polyamide resin or the like. When the intermediate layer is formed with the use of a resin having a glass transition temperature of at least 60° C. or a resin to be cured by a curing agent or the like, it is possible to prevent the image-receiving sheets for thermal transfer printing from being adhered to each other upon storing a plurality of image-receiving sheets in a stacked state, thus improving storability of the image-receiving sheet.

In addition, it is possible to impart an antistatic property to the image-receiving sheets for thermal transfer printing by forming the intermediate layer by means of an application of a composition to the substrate, which has been prepared by dissolving or dispersing (1) the same resin as described above and (2) an antistatic agent or a resin having an antistatic property in a solvent.

Examples of the antistatic agent may include fatty acid ester, sulfuric ester, phosphoric ester, amide, quaternary ammonium salt, betaine, amino acid, acrylic resin, ethylene oxide adduct and the like.

There may be used, as the resin having an antistatic property, for example, a electrical conductive resin which is obtained by introducing or copolymerizing a group having an antistatic effect such as quaternary ammonium salt, phosphoric acid, ethosulfate, vinylpyrrolidone, sulfonic acid or the like into a resin such as acrylic resin, vinyl resin or cellulose resin. It is especially preferable to use cation-modified acrylic resin.

These groups having the antistatic property are preferably introduced into the resin in the form of a pendant, by which such groups can be introduced into the resin at a high density. Concrete product names of these groups may include a series of "JURYMER" manufactured by NIPPON JUNYAKU Co., Ltd., a series of "REOLEX" manufactured by DAIICHI KOGYO SEIYAKU Co., Ltd. and a series of "ELECOND" manufactured by SOKEN KAGAKU Co., Ltd.

[Back Surface Layer]

A back surface layer may be formed on the surface of the substrate, which is opposite to the surface thereof having the receptor layer formed thereon, in order to improve the carrying property of the image-receiving sheet for thermal transfer printing and prevent the image-receiving sheet from being curled up. As a materials for forming the back surface layer having such functions, there may be used a mixture in which an organic filler such as an acrylic filler, a polyamide filler, a fluorinated filler or polyethylene wax, and/or an inorganic filler such as silicon dioxide or metallic oxides is added as an additive to resin such as acrylic resin, cellulose resin, polycarbonate resin, polyvinyl acetal resin. polyvinyl alcohol resin, polyamide resin, polystyrene resin, polyester resin and halogenated polymer.

The back surface layer is preferably formed by curing the above-mentioned resin with the use of a curing agent. Any generally known curing agent may be used, and isocyanate compound is preferably used. The resin for forming the back surface layer is caused to react on the curing agent such as the isocyanate compound to produce an urethane-bonding so as to form a stereoscopic cured structure, thus improving a heat-resistant storing property and a solvent-resistant property, and further improving an adhesivity to the substrate. An amount of added curing agent is preferably within a range of from 1 to 2 reacting-group equivalent relative to one reacting-group equivalent in the resin. With an amount of the curing agent of under 1 reacting-group equivalent, a long period of time is required for the completion of the curing, and the heat-resistant property and the solvent-resistant property are deteriorated. With an amount of the curing agent of over 2 reacting-group equivalent, there may occur an unfavorable variation of the formed back surface layer after the lapse of time, and the service life of a composition for forming the back surface layer may become short.

In addition, the organic filler or the inorganic filler may be added as an additive to the composition for forming the back surface layer. Such a filler has a function of improving the carrying property of the image-receiving sheet for thermal transfer printing in a printer, and preventing a blocking phenomenon, resulting in improvement of the storing property of the image-receiving sheet Examples of the organic filler may include an acrylic filler, a polyamide filler, a fluorinated filler and polyethylene wax. Of these organic fillers, the polyamide filler is preferably used. Examples of the inorganic filler may include silicon dioxide and metallic oxides.

There is preferably used the polyamide filler which is globular and has a molecular weight of from 100,000 to 900,000, preferably of from 100,000 to 500,000 and an average particle size of from 0.01 to 30 $\mu$m, preferably of from 0.01 to 10 $\mu$m. With respect to a kind of polyamide filler, "Nylon 12" filler is more preferably used since it has an excellent water resistant property in comparison with "Nylon 6" or "Nylon 66" filler, so as to cause no occurrence of characteristic variation due to the water absorption.

The polyamide filler has a high melting point, and a excellent oil resistant and chemical resistant property, and is thermally stable and tends not to be dyed by a dye. The molecular weight of from 100,000 to 900,000 of the polyamide filler may cause almost no abrasion, and provide self-lubricity and a low friction coefficient, thus causing almost no occurrence of flaws on an object to be in contact with the back surface layer.

A preferable average particle size of the above-mentioned polyamide filler ranges from 0.1 to 30 $\mu$m in case of an image-receiving sheet for the reflection-type image formation, and ranges from 0.01 to 1 $\mu$m in case of an image-receiving sheet for the transmission-type image formation (i.e., for a projection sheet for the OHP). When the average particle size of the polyamide filler is excessively small, the filler particles may be embedded in the inside of the back surface layer, thus making it impossible to achieve a sufficient lubricative function. When the average particle size thereof is excessively large, the filler particles may excessively be projected from the surface of the back surface layer, thus resulting in an increased friction coefficient, or the filler particles may come away from the back surface layer.

A blending ratio of the filler to the resin for the back surface layer preferably ranges from 0.01 wt. % to 200 wt. %. The blending ratio thereof preferably ranges from 1 wt. % to 100 wt. % in case of an image-receiving sheet for the reflection-type image formation, and ranges from 0.05 wt. % to 2 wt. % in case of an image-receiving sheet for the transmission-type image formation. With a blending ratio thereof of under 0.01 wt. %, there may merely be obtained insufficient lublicity, thus causing a problem that the sheets jam a printer upon, for example, the supply or discharge thereof. With a blending ratio thereof of over 200 wt. %, there may be obtained an excessively high lublicity, thus causing a problem of a shear in color in a thermally transferred image.

[Adhesion Promotive Layer]

An adhesion promotive layer may be formed on one surface and/or the other surface of the substrate by applying an adhesion promotive layer forming composition to the surface and/or the other surface thereof, which comprises adhesive resin such as acrylic acid ester resin, polyurethane resin or polyester resin. The one surface and/or the other surface of the substrate may be subjected to a corona discharge treatment without forming the above-mentioned adhesion promotive layer, to improve the adhesivity between the substrate and a layer to be formed thereon.

[Antistatic Layer]

An antistatic layer may be formed on one surface and/or the other surface of the substrate, or the image-receiving surface and/or the back surface of the image-receiving sheet for thermal transfer printing. The antistatic layer can be formed by applying a composition in which an antistatic agent such as fatty acid ester, sulfuric ester, phosphoric ester, amide, quaternary ammonium salt, betaine, amino acid, acrylic resin, ethylene oxide adduct and the like is dissolved or dispersed in a solvent, to a surface on which the antistatic layer is to be formed, and drying the thus applied composition.

A coating amount of the antistatic layer preferably ranges from 0.001 $g/m^2$ to 0.1 $g/m^2$.

The image-receiving sheet for thermal transfer printing having the antistatic layer formed on its outermost layer has an excellent antistatic property before carring out the thermally transfer printing, thus permitting the prevention of occurrence of abnormal feeding of sheets such as the so called "double feeding" phenomenon. It is also possible to prevent problems such as an incompletely formed image in which portions of the image are omitted, caused by the adsorption of dust on the surface of the image-receiving sheet.

[EXAMPLES]

Now, the present invention will be described hereinafter in more detail with reference to Experiment Examples and Comparative Examples.

The following release agents were prepared for the purpose of forming the image-receiving sheets for thermal transfer printing:

<Release Agent No. 1>

Methylsilyltriisocyanate (expressed by the formula (1), wherein, 1=1 and R=$CH_3$; having the product name "ORGATIX SIC-434" manufactured by Co., Ltd. Matsumoto Kosho; and having effective ingredients of 10%)

<Release Agent No. 2>

Hydroxyl group modified silicone (expressed by the formula (2), wherein, $R^2$ at both ends of the main chain is —$CH_3$, and $R^2$ at the side chain is —$(CH_2)_2OH$; having a substitution rate of methyl group as $R^3$ with phenyl group of 22 mol. %; OH equivalent of about 0.25 mol./100 g; and a molecular weight of about 2000)

<Release Agent No. 3>

Amino modified silicone (expressed by the formula (2), wherein, $R^2$ at both ends of the main chain is —$CH_3$, and $R^2$ at the side chain is —$C_3H_6NH_2$; having a substitution rate of methyl group as $R^3$ with phenyl group of 22 mol. %; amino equivalent of about 0.25 mol./100 g; and a molecular weight of about 2000)

<Release Agent No. 4>

Epoxy modified silicone (expressed by the formula (2), wherein, $R^2$ at both ends of the main chain is —$CH_3$, and $R^2$ at the side chain is —$C_3H_6OCH_2CHCH_2$; and having a substitution rate of methyl group as $R^3$ with phenyl group of 22 mol. %; epoxy equivalent of about 0.25 mol./100 g; and a molecular weight of about 2000)

<Release Agent No. 5>

Addition polymerization type silicone (prepared by mixing vinyl modified silicone of 1 wt. parts expressed by the formula (3) and hydrogen modified silicone of 2 wt. parts expressed by the formula (4). Repeated units in the formulae (3) and (4) may be arranged at random. Each of "c", "d", "e" and "f" indicates an integer equal to or more than zero. A sum of "c" and "d", and a sum of "e" and "f" respectively amount to at least 1. In each of the formula (3) and (4), a substitution rate of methyl group with phenyl group is 30 mol. %, and a molecular weight is 7000. The vinyl modified silicone has an amount of reaction group of about 15 mol. %. The hydrogen modified silicone has an amount of reaction group of about 30 mol. %, and in the formula (4), $R^4$ at both ends of the main chain is methyl group, and $R^4$ at the side chain is a hydrogen atom.

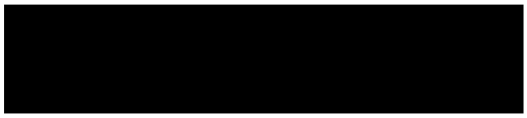

(3)

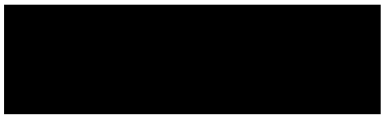

(4)

(Experiment Example No. 1)

A transparent substrate of the PET film ("LUMIRROR" manufactured by TORAY Co., Ltd.) having a thickness of 100 $\mu$m was used as a substrate. The image-receiving sheet for thermal transfer printing of the present invention was obtained by applying a receptor layer forming composition No. 1 having the following composition onto the one surface of the substrate by means of a wire bar, and drying the thus applied composition at an atmospheric temperature of 130° C. for 30 second so that the coating weight became 4.0 $g/m^2$ at a drying condition.

<Receptor Layer Forming Composition No. 1>

| | |
|---|---|
| Polyester resin (VYLON 200, mfd. by TOYOBO Co., Ltd.) | 100 wt. parts |
| Release agent No. 1 | 50 wt. parts |
| Methyl ethyl ketone/toluene (wt. ratio 1/1) | 400 wt. parts |

(Experiment Example No. 2)

The image-receiving sheet for thermal transfer printing of the present invention was obtained in the same manner as in the Experiment Example No. 1 except that the receptor layer forming composition was substituted by a receptor layer forming composition No. 2 having the following composition.

<Receptor Layer Forming Composition No. 2>

| | |
|---|---|
| Butyral resin (#3000K, mfd. by DENKI KAGAKU KOGYO Co., Ltd.) | 100 wt. parts |
| Release agent No. 1 | 50 wt. parts |
| Methyl ethyl ketone/toluene (wt. ratio 1/1) | 400 wt. parts |

(Experiment Example No. 3)

The image-receiving sheet for thermal transfer printing of the present invention was obtained in the same manner as in the Experiment Example No. 1 except that the receptor layer forming composition was substituted by a receptor layer forming composition No. 3 having the following composition.

<Receptor Layer Forming Composition No. 3>

Vinyl chloride-vinyl acetate-hydroxy acrylate copolymer resin (having the polymerization degree of 850; and having vinyl chloride content of 90 wt. %; vinyl acetate content of 3 wt. %; hydroxy acrylate content of 7 wt. %) 100 wt. parts
Release agent No. 1 50 wt. parts
Methyl ethyl ketone/toluene (wt. ratio 1/1) 400 wt. parts (Experiment Example No. 4)

The image-receiving sheet for thermal transfer printing of the present invention was obtained in the same manner as in the Experiment Example No. 1 except that the receptor layer forming composition was substituted by a receptor layer forming composition No. 4 having the following composition.

<Receptor Layer Forming Composition No. 4>

| | |
|---|---|
| Polyester resin (VYLON 200, mfd. by TOYOBO Co., Ltd.) | 100 wt. parts |
| Release agent No. 1 | 40 wt. parts |
| Release agent No. 2 | 1 wt. parts |
| Methyl ethyl ketone/toluene (wt. ratio 1/1) | 400 wt. parts |

(Experiment Example No. 5)

The image-receiving sheet for thermal transfer printing of the present invention was obtained in the same manner as in the Experiment Example No. 1 except that the receptor layer forming composition was substituted by a receptor layer forming composition No. 5 having the following composition.

<Receptor Layer Forming Composition No. 5>

| | |
|---|---|
| Polyester resin (VYLON 200, mfd. by TOYOBO Co., Ltd.) | 100 wt. parts |
| Release agent No. 1 | 30 wt. parts |
| Release agent No. 3 | 2 wt. parts |
| Methyl ethyl ketone/toluene (wt. ratio 1/1) | 400 wt. parts |

(Comparative Example No. 1)

The image-receiving sheet for thermal transfer printing of the Comparative Example No. 1 was obtained in the same manner as in the Experiment Example No. 1 except that the receptor layer forming composition was substituted by a receptor layer forming composition No. 6 having the following composition.

<Receptor Layer Forming Composition No. 6>

| | |
|---|---|
| Polyester resin (VYLON 200, mfd. by TOYOBO Co., Ltd.) | 100 wt. parts |
| Release agent No. 2 | 5 wt. parts |
| Isocyanate compound (TAKENATE A-14 mfd. by TAKEDA YAKUHIN KOGYO Co., Ltd.) | 8 wt. parts |
| Tin catalyst (dilauric acid-di-n-butyl tin mfd. by TOKYO KASEI KOGYO Co., Ltd.) | 0.2 wt. parts |
| Methyl ethyl ketone/toluene (wt. ratio 1/1) | 400 wt. parts |

(Comparative Example No. 2)

The image-receiving sheet for thermal transfer printing of the Comparative Example No. 2 was obtained in the same manner as in the Experiment Example No. 1 except that the receptor layer forming composition was substituted by a receptor layer forming composition No. 7 having the following composition.

<Receptor Layer Forming Composition No. 7>

| | |
|---|---|
| Polyester resin (VYLON 200, mfd. by TOYOBO Co., Ltd.) | 100 wt. parts |
| Release agent No. 3 | 3 wt. parts |
| Release agent No. 4 | 3 wt. parts |
| Methyl ethyl ketone/toluene (wt. ratio 1/1) | 400 wt. parts |

(Comparative Example No. 3)

The image-receiving sheet for thermal transfer printing of the Comparative Example No. 3 was obtained in the same manner as in the Experiment Example No. 1 except that the receptor layer forming composition was substituted by a receptor layer forming composition No. 8 having the following composition.

<Receptor Layer Forming Composition No. 8>

| | |
|---|---|
| Polyester resin (VYLON 200, mfd. by TOYOBO Co., Ltd.) | 100 wt. parts |
| Release agent No. 5 | 3 wt. parts |
| Methyl ethyl ketone/toluene (wt. ratio 1/1) | 400 wt. parts |

Each of the image-receiving sheets of the Experiment Examples of the present invention and the Comparative Examples was placed on a sublimation type thermal transfer sheet generally marketed so that the receptor layer of the former came into contact with the dyeing layer of the latter. Heat was applied to the back surface of the thermal transfer sheet by means of a thermal head.

For each of the image-receiving sheets of the Experiment Examples of the present invention and the Comparative Examples, the existence of a phenomenon that the binder in the dyeing layer of the thermal transfer sheet was taken off and adhered to the receptor layer of the image-receiving sheet (which revealed the tone printing property), and abrasion resistance and releasability of a printed material were investigated.

Investigation methods will be described concretely below.

<Investigation Method for the Tone Printing Property>

Sixteen step-patterns in which the toning values were uniformly divided into a range of 0 to 255, were prepared in colors of (a) each of yellow, magenta and cyan, and (b) black obtained by applying three layers of yellow, magenta and cyan to the image-receiving sheet with the use of a printer which had a thermal head having a linear density of 300 dpi mounted thereon and had capability for conducting the tone control in 256 stages. Printing conditions comprised a printing speed of 10 msec./line and a maximum impressed energy of 0.65 mJ/dot at the sixteenth step.

Evaluation criteria for the tone printing property were as follows:

○: No abnormal printing was observed.

X: The binder in the dyeing layer of the thermal transfer sheet was taken off and adhered to the receptor layer of the image-receiving sheet.

<Investigation Method for the Abrasion Resistance>

There were prepared a plural pieces of each of the image-receiving sheets of the Experiment Examples of the present invention and the Comparative Examples. A set of the image-receiving sheets was charged into a cassette for the image-receiving sheets of the printer. The image-receiving sheets were automatically fed one by one to conduct a thermal transfer printing on the entire surface thereof in black color in an intermediate tone. With respect to the printing conditions, the toning value of the above-mentioned tone printing condition corresponded to that at the 127th toning stage.

The plural pieces of image-receiving sheets charged in the cassette therefor in a stacked condition were fed one by one by means of a pickup roll. In general, when image-receiving sheets had for example been placed with its respective receptor layers down, there had caused abrasion between the receptor layer of the upper image-receiving sheet pressed by a pickup roll and a back surface of the lower image-receiving sheet located on the upper image-receiving sheet, and flaws had been caused on a portion of the image-receiving sheet, with which the pickup roll had brought in contact. The portion thereof having such flaws had sometimes exhibited insufficient releasability, leading to an abnormal printing. The existence of such flaws was therefore observed by optical inspection. Of the set of stacked image-receiving sheets, the uppermost and lowermost image-receiving sheets were excluded from the objects to be evaluated. Evaluation criteria were as follows:

○: Almost no flaws were observed by optical inspection.

δ: Flaws were observed by optical inspection, but no abnormal printing was caused.

X: Flaws were observed by optical inspection, and abnormal printing was caused in the portion having the flaws.

<Investigation Method for the Releasability>

Each of the image-receiving sheets of the Experiment Examples of the present invention and the Comparative Examples was placed on a sublimation type thermal transfer sheet generally marketed so that the receptor layer of the former came into contact with the dyeing layer of the latter, and a thermal transfer printing was conducted on the entire surface of the image-receiving sheet in black color in high depth. With respect to the printing conditions, the toning value of the above-mentioned tone printing condition corresponded to that at the 255th toning stage. The optical inspection was given to the image-receiving sheet so as to evaluate the releasability of the image-receiving sheet from the sublimation type thermal transfer sheet. Evaluation criteria were as follows:

○: No abnormal printing was observed.

X: Abnormal printing was caused, thus making it impossible to conduct a printing in three colors (There was caused the abnormal printing that the receptor layer was taken off and adhered to the thermal transfer sheet, or the binder in the dyeing layer of the thermal transfer sheet was taken off and adhered to the receptor layer).

Evaluation results are shown in Table 1 below.

TABLE 1

| | Tone printing | Abrasion resistance | Releasability | Synthetic evaluation |
|---|---|---|---|---|
| Experiment Example No. 1 | ○ | ○ | ○ | ○ |
| Experiment Example No. 2 | ○ | ○ | ○ | ○ |
| Experiment Example No. 3 | ○ | ○ | ○ | ○ |
| Experiment Example No. 4 | ○ | ○ | ○ | ○ |
| Experiment Example No. 5 | ○ | ○ | ○ | ○ |
| Comparative Example No. 1 | x | x | ○ | x |
| Comparative Example No. 2 | x | Δ | x | x |
| Comparative Example No. 3 | ○ | x | ○ | x |

According to the present invention as described above in detail, there can be provided the image-receiving sheet for thermal transfer printing which has an excellent releasability, prevents itself from being heat-fused onto a heat transfer sheet upon forming an image, and permits the formation of the image in high depth. There is caused no flaws on the receptor layer of the image-receiving sheet, even when there is friction between the stacked pieces of image-receiving sheets and/or there is also friction between the surface of the receptor layer and parts of a printer, during the feeding of the image-receiving sheets in the printer, thus avoiding the occurrence of problems such as abnormal printing due to flaws produced on the conventional image-receiving sheet, thus making it possible to provide the image-receivingsheet for thermal transfer printing having high reliability.

In addition, it is possible to manufacture the image-receiving sheet for thermal transfer printing through a low temperature drying process, so as to inhibit the substrate from being damaged by heat, thus preventing the thermal contraction of the substrate, resulting in the improvement in unevenness of the surface thereof. A short period of time is required for the drying process, thus permitting the manufacture of the image-receiving sheet for thermal transfer printing having high productivity.

What is claimed is:

1. An image-receiving sheet for thermal transfer printing, which comprises a substrate and a receptor layer provided on at least one surface of said substrate, wherein:

said receptor layer is formed by applying a receptor layer forming composition comprising (a) at least one thermoplastic resin and (b) at least one release agent selected from silicon compounds expressed by the following formula (1):

$$R_1—Si—(NCO)_{4-1} \quad (1)$$

in said formula (1), "1" indicates an integer of from 0 to 3, and "R" indicates an alkyl group, an aryl group or a vinyl group, to said at least one surface of said substrate, and drying the thus applied composition by heat.

2. An image-receiving sheet for thermal transfer printing, as claimed in claim 1, wherein;

said receptor layer forming composition further comprises at least one modified silicon having active hydrogen.

3. An image-receiving sheet for thermal transfer printing, as claimed in claim 2, wherein:

said modified silicon having said active hydrogen is the modified silicon expressed by the following formula (2):

$$R^2-Si(R^3)_2-O-\left[\begin{array}{c}R^2\\|\\Si(R^3)-O\end{array}\right]_a-\left[Si(R^3)_2-O\right]_b-Si(R^3)_2-R^2 \quad (2)$$

in said formula (2), each siloxane unit may be arranged at random; each of "a" and "b" indicates an integer equal to or more than zero, and a sum of "a" and "b" amounts to at least 1; each "$R^2$" independently indicates a methyl group or a group selected from the group consisting of $-(CH_2)_m-OH$, $-(CH_2)_n-COOH$ and $-C_3H_6NH_2$; each of "m" and "n" indicates an integer of from 0 to 5; and "$R^3$" indicates a methyl group, however, part of "$R^3$" may be substituted by at least one selected from the group consisting of an ethyl group, a phenyl group and a 3,3,3-trifluoropropyl group.

4. An image-receiving sheet for thermal transfer printing, as claimed in claim 1, wherein:

said at least one thermoplastic resin has a functional group.

5. An image-receiving sheet for thermal transfer printing, as claimed in claim 4, wherein:

said thermoplastic resin includes active hydrogen in place of said functional group.

6. An image-receiving sheet for thermal transfer printing, as claimed in claim 1, further comprising an intermediate layer wherein:

said receptor layer is provided on said at least one surface of said substrate through said intermediate layer.

7. An image-receiving sheet for thermal transfer printing, as claimed in claim 1, wherein:

there is provided on a back surface side of said substrate a back surface layer comprising globular polyamide filler having a molecular weight of from 100,000 to 900,000 and an average particle size of from 0.01 to 30 $\mu$m.

8. A method for manufacturing an image-receiving sheet for thermal transfer printing, which comprises the steps of:

applying a receptor layer forming composition comprising (a) at least one thermoplastic resin and (b) at least one release agent selected from silicon compounds expressed by the following formula (1):

$$R_1-Si-(NCO)_{4-1} \quad (1)$$

in said formula (1), "1" indicates an integer of from 0 to 3, and "R" indicates an alkyl group, an aryl group or a vinyl group, to at least one surface of a substrate; and drying the thus applied composition by heat to form a receptor layer on said at least one surface of said substrate.

9. A method for manufacturing an image-receiving sheet for thermal transfer printing, as claimed in claim 8, wherein:

said receptor layer forming composition further comprises at least one modified silicon having active hydrogen.

10. A method for manufacturing an image-receiving sheet for thermal transfer printing, as claimed in claim 9, wherein:

said modified silicon having said active hydrogen is modified silicon expressed by the following formula (2):

$$R^2-Si(R^3)_2-O-\left[\begin{array}{c}R^2\\|\\Si(R^3)-O\end{array}\right]_a-\left[Si(R^3)_2-O\right]_b-Si(R^3)_2-R^2 \quad (2)$$

in said formula (2), each siloxane unit may be arranged at random; each of "a" and "b" indicates an integer equal or more than zero, and a sum of "a" and "b" amounts to at least 1; each "$R^2$" independently indicates a methyl group or a group selected from the group consisting of $-(CH_2)_m-OH$, $-(CH_2)_n-COOH$ and $-C_3H_6NH_2$; each of "m" and "n" indicates an integer of from 0 to 5; and "$R^3$" indicates a methyl group, however, part of "$R^3$" may be substituted by at least one kind of group selected from the group consisting of an ethyl group, a phenyl group and a 3,3,3-trifluoropropyl group.

11. A method for manufacturing an image-receiving sheet for thermal transfer printing, as claimed in claim 8, wherein:

said at least one thermoplastic resin has a functional group.

12. A method for manufacturing an image-receiving sheet for thermal transfer printing, as claimed in claim 11, wherein:

said thermoplastic resin includes active hydrogen as said functional group.

* * * * *